United States Patent [19]

Dyer

[11] 4,155,128

[45] May 22, 1979

[54] TOILET TANK FLUSH VALVE ASSEMBLY

[76] Inventor: Arthur M. Dyer, 1949 Washington St., Lemon Grove, Calif. 92045

[21] Appl. No.: 919,847

[22] Filed: Jun. 28, 1978

[51] Int. Cl.[2] ..... E03D 1/35

[52] U.S. Cl. ..... 4/392; 4/393; 4/394; 4/397; 4/400

[58] Field of Search ..... 4/324, 325, 395, 394, 4/396, 397, 398, 399, 400, 401, 405, 393

[56] References Cited

U.S. PATENT DOCUMENTS

| | | | |
|---|---|---|---|
| 2,668,297 | 2/1954 | Reed | 4/398 |
| 2,744,259 | 5/1956 | Dague | 4/324 |
| 2,811,723 | 11/1957 | Fightmaster et al. | 4/398 |
| 2,820,968 | 1/1958 | Fightmaster | 4/400 |
| 3,187,348 | 6/1965 | Gresham | 4/400 |
| 3,579,649 | 5/1971 | Dyer | 4/400 |
| 3,831,204 | 8/1974 | Cook | 4/394 |
| 3,908,203 | 9/1975 | Jackson | 4/394 |
| 4,060,858 | 12/1977 | Fabian | 4/400 X |

*Primary Examiner*—Henry K. Artis
*Attorney, Agent, or Firm*—Brown & Martin

[57] ABSTRACT

A toilet tank flush valve assembly including a vinyl foam valve closure element is disclosed. A guide element is attached to the bottom of the valve closure element and extends into the flush pipe when the valve closure element is seated for guiding the seating of the valve closure element. A linkage element links the bottom of the valve closure element to the inside of the flush pipe below the valve seat for limiting upward vertical movement of the valve closure element and for limiting revolution of the valve closure element about the overflow pipe when the valve closure element is lifted off of the valve seat so that the bottom extremity of the guide is not moved horizontally to a position that is not within the valve seat.

A vinyl foam disc-shaped buoy is attached to the top of the valve closure element by a ball chain and is restrained from moving more than a predetermined length of the chain from the valve closure element. The buoy prevents the valve closure element from seating during an interval from when the valve closure element has been lifted from the valve seat until the water level in the toilet tank recedes to less than approximately the predetermined length above a valve seat. A weight is attached to the bottom of the valve closure element for forcing the valve closure element to seat when the buoy does not prevent the valve closure element from seating.

8 Claims, 4 Drawing Figures

TOILET TANK FLUSH VALVE ASSEMBLY

BACKGROUND OF THE INVENTION

The present invention generally pertains to toilet tank flush valve assemblies and is particularly directed to improving the consistency of operation of such assemblies so as to enable better conservation of water.

A typical toilet tank includes a flush pipe having a valve seat for receiving a valve closure element, an upright overflow pipe, and a drain port connecting the overflow pipe to the flush pipe below the valve seat. The valve closure element prevents water from flowing from the tank when the valve closure element is seated on the valve seat.

Typically the valve closure element is a buoyant flapper or ball made of rubber or like material. The flapper or ball type valve closure element is lifted from the valve seat by a chain or rod by operation of a flush lever handle when it is desired to flush the toilet. When the valve closure element is lifted water empties from the toilet tank through the flush pipe. Then, new water enters the toilet tank as the valve closure element is reseated.

When the water empties from the toilet tank through the flush pipe it flows into the toilet bowl. The toilet bowl is flushed of its contents if the pressure created by the water flowing into it from the tank is great enough to cause the water in the bowl to be siphoned therefrom. Accordingly the tank must contain at least a certain quantity of water in order to provide the necessary pressure to initiate the siphoning of the water from the bowl.

However, the bowl usually is flushed by the time that half the water in the tank has emptied therefrom. Yet because the flush valve is open the water continues to empty from the tank and flows into and through the bowl. The bowl is not flushed a second time, however, because the water in the tank has dropped to such a level that it no longer flows into the bowl under sufficient pressure to again cause all of the contents of the bowl to be siphoned therefrom. Thus, the last portion of the water that empties from the tank merely flows through the bowl and down the drain. It is in effect wasted.

Also the water that is wasted includes not only the excess contents of the tank at the time the flush valve is opened, but also the additional water that flows into the tank while the flush valve is open. Typically it takes almost twice as long for the tank to empty after it is only half-full as it did for the tank to drain until it was only half-full.

Attempts have been made to conserve the water remaining in the tank at the time the flushing of the bowl is completed by effecting closure of the flush valve at that time. An example of such an attempt is described in applicant's U.S. Pat. No. 3,350,723 wherein there is described a system where a floating vessel rigidly attached to a ball type valve closure element forces the valve closure element from above to seat on the valve seat when the water level in the tank has receded to a predetermined level above the valve seat. This attempt did not prove satisfactory, however, because the valve closure element did not consistently seat accurately enough on the valve seat to prevent leakage.

Another factor considered in attempting to conserve water is seating of the valve closure element on the valve seat.

As most persons have observed from time to time, the valve closure element in a given flush valve assembly does not reseat as quickly on some occasions as it does on others. This variation in the time for reseating the valve closure element appears to be related to the construction of these typical state of the art flush valve assemblies.

Reseating of the ball, and flapper type valve closure elements is guided by means attached to the valve closure element from above the valve seat. The ball-type valve closure element is guided by a chain or rod which extends from the flush lever above the ball passing through a guide element extended from the overflow tank; and the flapper is guided by being hinged to a location adjacent the valve seat.

Ideally, the ball of flapper valve closure element floats back on the valve seat as the water runs out of the tank and into the flush pipe. However, both the ball and flapper valve closure elements sometimes reseat either early or late in relation to the emptying of the toilet tank.

The reseating of the flapper element is affected by the relative angle to the horizontal that the flapper valve closure element is lifted, and by both horizontal and vertical forces applied against the cocked-open valve closure element by the water flowing from the tank. As a result, if the flapper is not lifted very far, the vertically applied pressure of the outflowing water may cause the flapper to reseat early. If the flapper valve closure element is lifted too far, it may reseat late; and, depending upon its angle and the relative horizontal and vertical pressures of the outflowing water and the new water flowing in to the toilet tank, it may not reseat at all. Also flapper valve closure elements sometimes leak, whereby new water continues to run into the toilet tank.

The reseating of the ball valve element is also affected by how far the ball valve closure element is lifted from the valve seat; and accordingly the ball valve closure element also may reseat early or late.

The reseating of the ball valve closure element is further affected by such factors as corrosion and the forces of usage changing the alignment of the guide element, whereby the ball valve closure element may not accurately reseat and new water continues to run into the toilet tank.

Because of this inconsistency in the time for reseating the flapper or ball valve closure elements, the water level regulating means in many toilet tanks are so adjusted that the toilet tanks receive up to fifty percent more new water upon each refill than is needed for hygienic flushing of the toilet bowl, just so that a sufficient quantity of water flows down the flush pipe from the toilet tank for flushing on those occasions when the valve closure element reseats before the toilet tank is empty.

It is an object of the present invention to provide a flush valve assembly in which the valve closure element is consistently reseated so that only that quantity of water that is needed for hygienic flushing of the toilet bowl is emptied from the tank upon each flushing, whereby water is better conserved.

It is a further object of the present invention to provide a flush valve assembly in which the valve closure element is consistently reseated without leaking so as to prevent water from continuously running into the toilet tank and flowing out through the flush pipe.

SUMMARY OF THE INVENTION

The present invention is an improved toilet flush valve assembly in which the valve closure element is consistently seated without leaking, when the water in the tank recedes to a predetermined level above the valve seat, thereby providing the desired conservation of water.

Such consistent seating is achieved by a valve assembly which guides and forces the reseating of the valve closure element from within the flush pipe.

A toilet tank flush valve assembly according to the present invention includes a valve closure element for seating on the valve seat to prevent liquid from flowing from the tank; a guide element attached to the bottom of the valve closure element for extending into the flush pipe when the valve closure element is seated for guiding the seating of the valve element; a linkage element attached to the bottom of the valve closure element for linking the bottom of the valve closure element to the inside of the flush pipe below the valve seat for limiting upward vertical movement of the valve closure element and for limiting revolution of the valve closure element about the overflow pipe when the valve closure element is lifted off the valve seat; a buoy; a flexible linkage connecting the buoy to the top of the valve closure element; a restraint on the flexible linkage for restraining the buoy from moving more than a predetermined length of linkage from the valve closure element for preventing the valve closure element from seating on the valve seat during the interval from when the valve closure element has been lifted from the valve seat until the water level in the toilet tank recedes to less than approximately the predetermined length above the valve seat; and a weight attached to the bottom of the valve closure element for forcing the valve closure element to seat on the valve when the buoy does not prevent the valve closure element from seating.

The operation of the present invention and additional features thereof, are discussed below in the Description of the Preferred Embodiment.

DESCRIPTION OF THE PREFERRED EMBODIMENT

Figure 1:
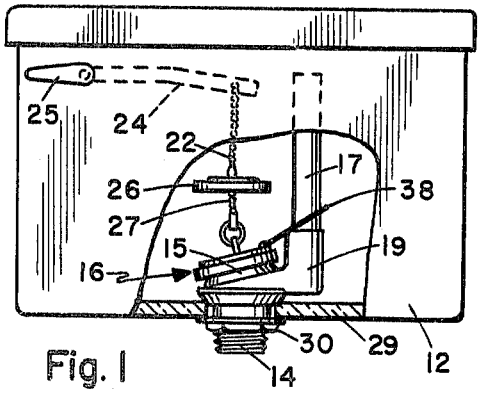
FIG. 1 is a side elevation view, partially cut away, of a toilet tank with the flush valve assembly of the present invention installed.

The flush valve assembly of the present invention is shown as installed in a toilet tank 12. The toilet tank 12 includes a flush pipe 14 having a valve seat 15 for receiving a valve closure element 16, an upright overflow pipe 17, and a pipe section 19 defining a drain port 20 connecting the overflow pipe 17 to the flush pipe 14 below the valve seat 15. The valve closure element 16 is connected by a ball chain 22 to a flush lever arm 24. A handle 25 is attached to the flush lever arm 24; and when the handle 25 is depressed, the valve closure element 16 is lifted from the valve seat 15 to thereby open the valve and enable the water in the toilet tank 12 to flow out through the flush pipe 14.

A buoy 26 is connected to the top of the valve closure element 16 by a flexible linkage 27, which forms the lower part of the chain 22. A ball chain fastener 28 connects the flexible linkage 27 to the remainder of the chain 22 and also restrains the buoy 26 from moving more than a predetermined distance of flexible linkage from the valve closure element 16.

The outside of the flush pipe 14 is threaded, and the flush pipe 14 is secured to the tank bottom 29 by a nut 30 and a gasket 31, which is inserted between the flush pipe 14 and the tank bottom 27.

Figure 2:
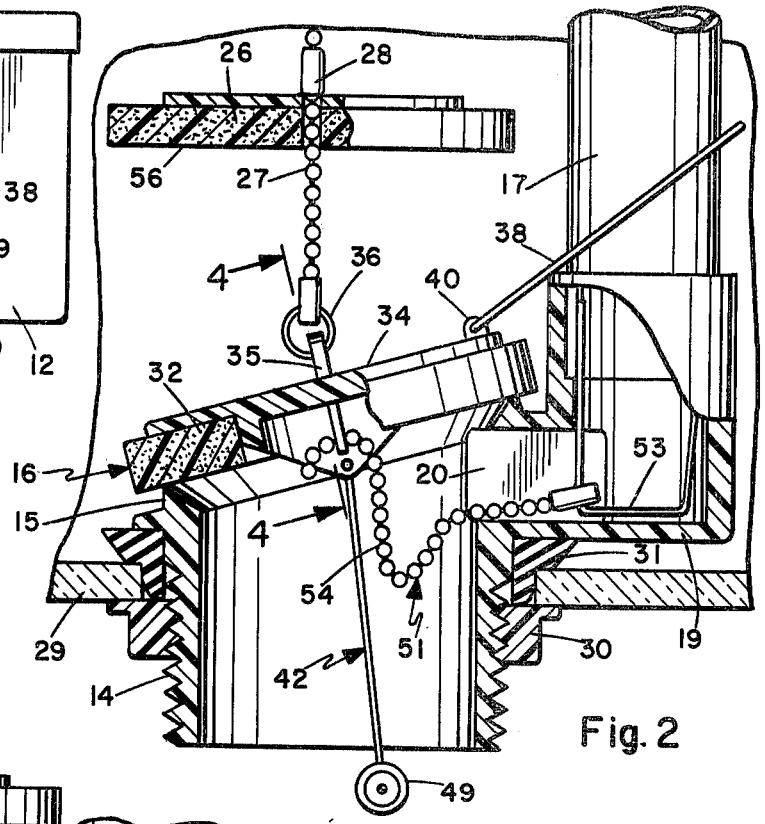
FIG. 2 is an enlarged view with portions cut away of the flush valve assembly with the valve closed.
Figure 3:
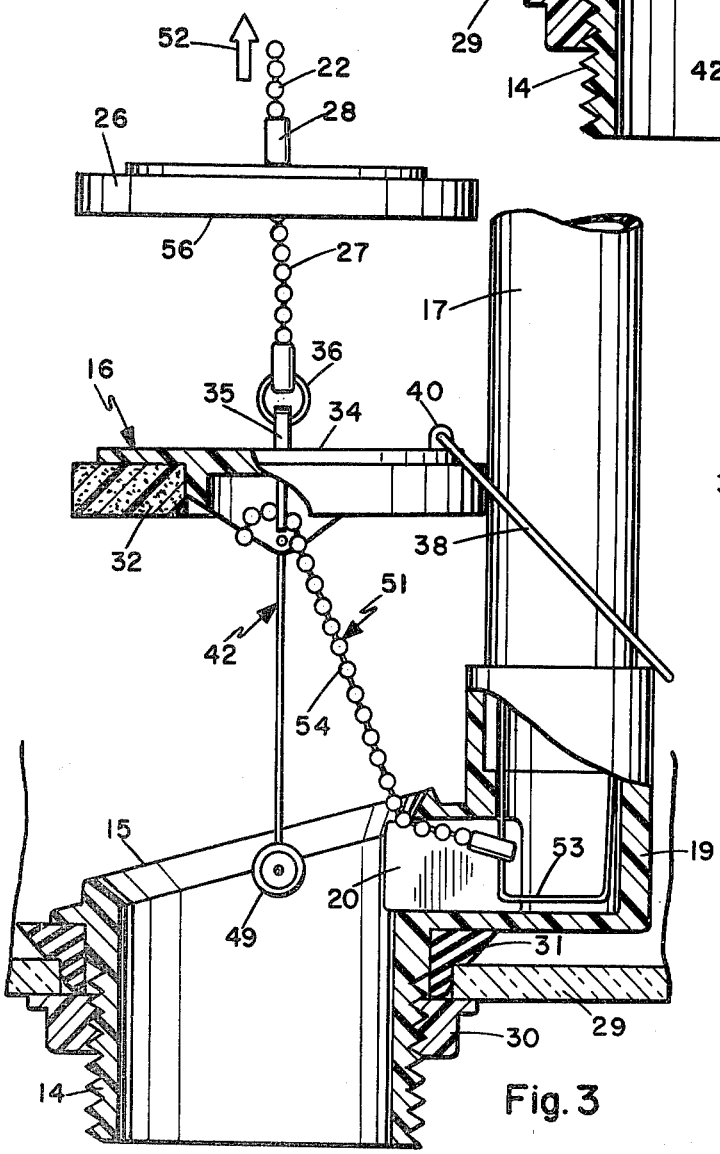
FIG. 3 is a view similar to FIG. 2, but with the valve opened.
Figure 4:
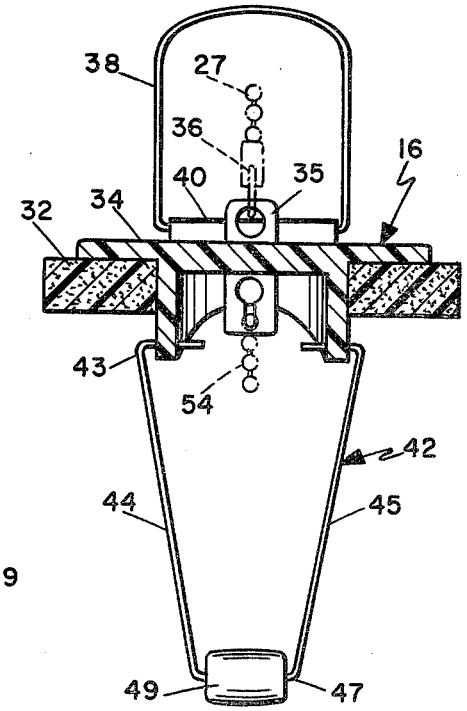
FIG. 4 is a sectional view taken along line 4—4 in FIG. 2 of the valve closure element with the guide element and a restraining element attached thereto.

Referring to FIGS. 2–4, the body of the valve closure element 16 is circular and includes soft vinyl foam 32 about its circumference for seating upon the valve seat 15.

The valve closure element 16 includes a plastic cap 34 centered on top of the vinyl foam 32. An element defining an eye 35 is centered on the top of the cap for enabling the valve closure element 16 to be connected to the chain 22 by a ring 36 through the eye 35 and the lower end of the chain 22.

A restraining element in the form of a rigid wire yoke 38 is attached to the top of the valve closure element 16. The ends of the yoke 38 are loosely secured in a rib 40 on the top of the cap 34 for revolution about the rib 40. The yoke 38 extends above the valve seat 15 when the valve closure element 16 is seated for loosely ringing the overflow pipe 17. When the valve closure element 16 is lifted off of the valve seat 15, the yoke 38 limits horizontal movement of the valve closure element 16 away from the valve seat 15 in a direction away from the overflow pipe 17. The yoke 38 thereby assists in reseating the valve closure element 16.

A guide element 42 is attached to the bottom of the valve closure element 16 and extends into the flush pipe when the valve closure element 16 is seated, as shown in FIG. 2. The guide element 42 guides the seating of the valve closure element 16. The guide element 42 is a rigid wire 43 that is tapered on each side 44, and 45 to have a smaller dimension as it extends from the valve closure element 16.

The sides 44 and 45 of the guide element 42 of the guide element 42 by a bite 47. A lead weight 49 is attached to the bite 47 of the guide element 42.

The flush valve assembly also includes a linkage element 51 for limiting upward vertical movement of the valve closure element 16 and for limiting revolution of the valve closure element 16 about the overflow pipe 17 when the valve closure element 16 is lifted off of the valve seat 15 in the direction of the arrow 52. The linkage element 51 includes a U-shaped rigid wire 53 which is placed within the overflow pipe 17, and a flexible ball chain 54. The chain 54 is attached to the bottom of the valve closure element 16 and passes through the drain port 20 into the overflow pipe 17, where it is attached to the U-shaped rigid wire 52. Accordingly, the linkage element 54 limits vertical movement and revolution of the valve closure element 16 so that the bottom extremity 47 of the guide element 42 is limited from moving to a position that is not within the valve seat 15 when the valve closure element 16 is lifted off of the valve seat 15 (as shown in FIG. 2).

The closure of the flush valve is now discussed. The buoy 26 is restrained by a ball chain fastener 28 from moving more than a predetermined length of the flexible linkage 27 from the valve closure element 16. During an interval from when the valve closure element 16 has been lifted from the valve seat 15 until when the water level in the tank 12 recedes to less than approximately the predetermined length above the valve seat, the buoy 26 prevents the valve closure element 16 from seating on the valve seat 15. When the water recedes to this level so that the chain 27 flexes and the buoy 26 no longer prevents the valve closure element 16 from seating, the weight 49 attached to the bottom of the guide element 42 forces the valve closure element 16 to seat on the valve seat 15.

Once the valve is closed the pressure of the water in the tank upon the valve closure element 16 maintains the valve in the closed position until it is again opened by lifting the chain 22 in the direction of the arrow 52.

The buoy 26 has enough buoyancy to prevent the valve closure element 16 from seating on the valve seat 15 after the element 16 has been lifted therefrom and until the water recedes to the desired level, but not enough buoyancy to lift the valve closure element 16 off of the valve seat 15 once the valve closure element 16 has been seated.

The lower surface 56 of the buoy 26 is flat so as to maintain the broad dimension of the buoy 26 generally parallel to the current created by the water flowing from the tank 12 while the valve is open and the new water flowing into the tank before the valve is closed. The flexible chain 27, however, allows the buoy 26 to have a flexible relationship to the valve closure element 16 as the water recedes in the tank, such that when the water recedes to less then the predetermined level, the coincident lowering of the buoy 26 does not result in a force being transmitted from above to the top of the valve closure element 16, which could adversely affect the accuracy of the seating of the valve closure element 16.

Until the water recedes to the predetermined level the upward vertical force on the valve closure element 16 provided by the buoy 26 is only slightly greater than the downward vertical force on the valve closure element 16 provided by the weight 49, such that horizontal forces provided by water flowing through the tank 12 can cause the valve closure element 16 to be off center with relation to the valve seat 15. Once the water has receded to the predetermined level, however, the only significant vertical force which is applied to the valve closure element 16 is that which is applied from below by the weight 49, and this vertical force is sufficient to offset any horizontal forces provided by the water flowing through the tank 12 in order to center the valve closure element 16 in the valve seated 15, thereby assuring consistently accurate seating when the water in the tank 12 recedes to the predetermined level defined by the predetermined length of the flexible linkage 27.

I claim:

1. A toilet tank flush valve assembly for a toilet of the type including a flush pipe having a valve seat for receiving a valve closure element, an upright overflow pipe, and a drain port connecting the overflow pipe to the flush pipe below the valve seat, comprising a valve closure element for seating on said valve seat to prevent liquid flowing from said tank;

guide means attached to the bottom of the valve closure element for extending into said flush pipe when the valve closure element is seated for guiding said seating of the valve closure element;

linkage means attached to the bottom of the valve closure element for linking the bottom of the valve closure element to the inside of said flush pipe below said valve seat for limiting upward vertical movement of the valve closure element and for limiting revolution of the valve closure element about said overflow pipe when the valve closure element is lifted off of said valve seat;

a buoy;

a flexible linkage connecting the buoy to the top of the valve closure element;

restraining means attached to the flexible linkage for restraining the buoy from moving more than a predetermined length of linkage from the valve closure element for preventing the valve closure element from seating on the valve seat during an interval from when the valve closure element has been lifted from the valve seat until the level in the toilet tank recedes to less than approximately said predetermined length above the valve seat; and a weight attached to the bottom of the valve closure element for forcing the valve closure element to seat on the valve seat when the buoy does not prevent the valve closure element from seating.

2. A flush valve assembly according to claim 1, further comprising a a second restraining means attached to the valve closure element for extending above said valve seat when the valve closure element is seated for loosely ringing said overflow pipe in order to limit horizontal movement of the valve closure element in a direction away from said overflow pipe when the valve closure element is not seated.

3. A flush valve assembly according to claim 1, wherein the buoy includes a vinyl foam disc.

4. A flush valve assembly according to claim 1, wherein the linkage means comprises;

a second restraining means for placement within said overflow pipe; and a second flexible linkage attached to the bottom of the valve closure element for passage through the drain port to connect the second restraining means to the valve closure element for limiting said vertical movement and said revolution of the valve closure element to limit the bottom extremity of the guide means from moving to a position that is not within said valve seat when the valve closure element is lifted off of said valve seat.

5. A toilet tank flush valve assembly for a toilet of the type including a flush pipe having a valve seat for receiving a valve closure element, an upright overflow pipe, and a drain port connecting the overflow pipe to the flush pipe below the valve seat, comprising a valve closure element for seating on said valve seat to prevent liquid from flowing from said tank;

guide means for attachment to the bottom of the valve closure element for extending into said flush pipe when the valve closure element is seated for guiding said seating of the valve closure element;

linkage means for attachment to the bottom of the valve closure element for linking the bottom of the valve closure element to the inside of said flush pipe below said valve seat for limiting upward vertical movement of the valve closure element and for limiting revolution of the valve closure element about said overflow pipe when the valve closure element is lifted off of said valve seat;

a buoy;

a flexible linkage for connecting the buoy to the top of the valve closure element; restraining means for attachment to the flexible linkage for restraining the buoy from moving more than a predetermined length of linkage from the valve closure element for preventing the valve closure element from seating on the valve seat during an interval from when the valve closure element has been lifted from the valve seat until the water level in the toilet tank recedes to less than approximately said predetermined length above the valve seat; and a weight for attachment to the bottom of the valve closure element for forcing the valve closure element to seat on the valve seat when the buoy does not prevent the valve closure element from seating.

6. A flush valve assembly according to claim 5, further comprising a second restraining means for attachment to the valve closure element for extending above said valve seat when the valve closure element is seated for loosely ringing said overflow pipe in order to limit horizontal movement of the valve closure element in a direction away from said overflow pipe when the valve closure element is not seated.

7. A flush valve assembly according to claim 5, wherein the buoy includes a vinyl foam disc.

8. A flush valve assembly according to claim 5, wherein the linkage means comprises a second restraining means for placement within said overflow pipe; and a second flexible linkage for attachment to the bottom of the valve closure element for passage through the drain port to connect the second restraining means to the valve closure element for limiting said vertical movement and said revolution of the valve closure element to limit the bottom extremity of the guide means from moving to a position that is not within said valve seat when the valve closure element is lifted off of said valve seat.

* * * * *